US008424575B2

(12) United States Patent
Neumayer

(10) Patent No.: US 8,424,575 B2
(45) Date of Patent: Apr. 23, 2013

(54) APPARATUS FOR BOTTLING VISCOUS MEDIA

(75) Inventor: Walter Neumayer, Woerth/Donau (DE)

(73) Assignee: Krones AG (DE)

( * ) Notice: Subject to any disclaimer, the term of this patent is extended or adjusted under 35 U.S.C. 154(b) by 457 days.

(21) Appl. No.: 12/496,530

(22) Filed: Jul. 1, 2009

(65) Prior Publication Data

US 2010/0000628 A1 Jan. 7, 2010

(30) Foreign Application Priority Data

Jul. 1, 2008 (DE) ..... 10 2008 030 721

(51) Int. Cl.
*B67C 3/26* (2006.01)

(52) U.S. Cl.
USPC ..... 141/284; 141/1; 141/181

(58) Field of Classification Search ..... 141/1, 83, 141/148, 181, 182, 263, 264, 279, 284, 374
See application file for complete search history.

(56) References Cited

U.S. PATENT DOCUMENTS

| | | | | |
|---|---|---|---|---|
| 785,001 | A * | 3/1905 | Hicks | 53/275 |
| 2,893,444 | A | 7/1959 | Waddington et al. | 141/89 |
| 3,005,473 | A | 10/1961 | Ring | 141/86 |
| 3,073,400 | A * | 1/1963 | Bauder et al. | 177/56 |
| 3,097,671 | A * | 7/1963 | Bonetti et al. | 141/116 |
| 3,205,920 | A | 9/1965 | Cozzoli et al. | 141/90 |
| 3,765,142 | A | 10/1973 | Lindquist et al. | 53/11 |
| 3,814,147 | A | 6/1974 | Lindberg | 141/94 |
| 3,870,089 | A | 3/1975 | Laub, III | 141/44 |
| 3,978,900 | A | 9/1976 | Mencacci et al. | 141/11 |
| 4,824,546 | A | 4/1989 | Ohmi | 204/298 |
| 4,832,092 | A | 5/1989 | Hirose et al. | 141/1 |
| RE34,106 | E | 10/1992 | Ohmi | 204/298.08 |
| 6,662,828 | B1 * | 12/2003 | Stover et al. | 141/1 |
| 6,761,191 | B2 * | 7/2004 | Rosen et al. | 141/91 |

FOREIGN PATENT DOCUMENTS

| | | |
|---|---|---|
| CA | 2 465 969 | 5/2003 |
| CA | 2 416 556 | 4/2007 |
| CH | 681291 | 2/1993 |
| DE | 1 432 283 | 12/1968 |
| DE | 25 25 385 | 1/1976 |
| DE | 2525385 | 1/1976 |
| DE | 32 40 991 | 5/1984 |
| DE | 37 27 866 | 2/1988 |
| DE | 43 14 474 | 11/1994 |
| DE | 102 50 294 | 6/2003 |

(Continued)

OTHER PUBLICATIONS

German Search Report dated Jul. 17, 2008.

*Primary Examiner* — Gregory Huson
*Assistant Examiner* — Jason K Niesz
(74) *Attorney, Agent, or Firm* — Hayes Soloway P.C.

(57) ABSTRACT

An apparatus for filling containers with liquid and in particular viscous media, comprising a filling element which can be introduced at least partially into a mouth of the container to be filled, wherein a filling body of this filling element is configured in such a way that the medium is directed at least also onto a wall of the container, comprising a connecting line for conveying the liquid medium from a reservoir for the liquid medium to the container, wherein the filling element is movable relative to the container in a longitudinal direction (L) of the container. According to the invention, the filling element is movable in the longitudinal direction (L) of the container.

18 Claims, 3 Drawing Sheets

FOREIGN PATENT DOCUMENTS

| | | |
|---|---|---|
| DE | 10 2005 015 135 | 10/2006 |
| DE | 602 18 730 | 3/2007 |
| EP | 0 103 484 | 3/1984 |
| EP | 1 623 952 | 7/2005 |
| FR | 2 717 167 | 9/1995 |
| GB | 2 113 661 | 8/1983 |
| WO | WO 02/14207 | 2/2002 |
| WO | WO 02/098785 | 12/2002 |

* cited by examiner

Fig. 1
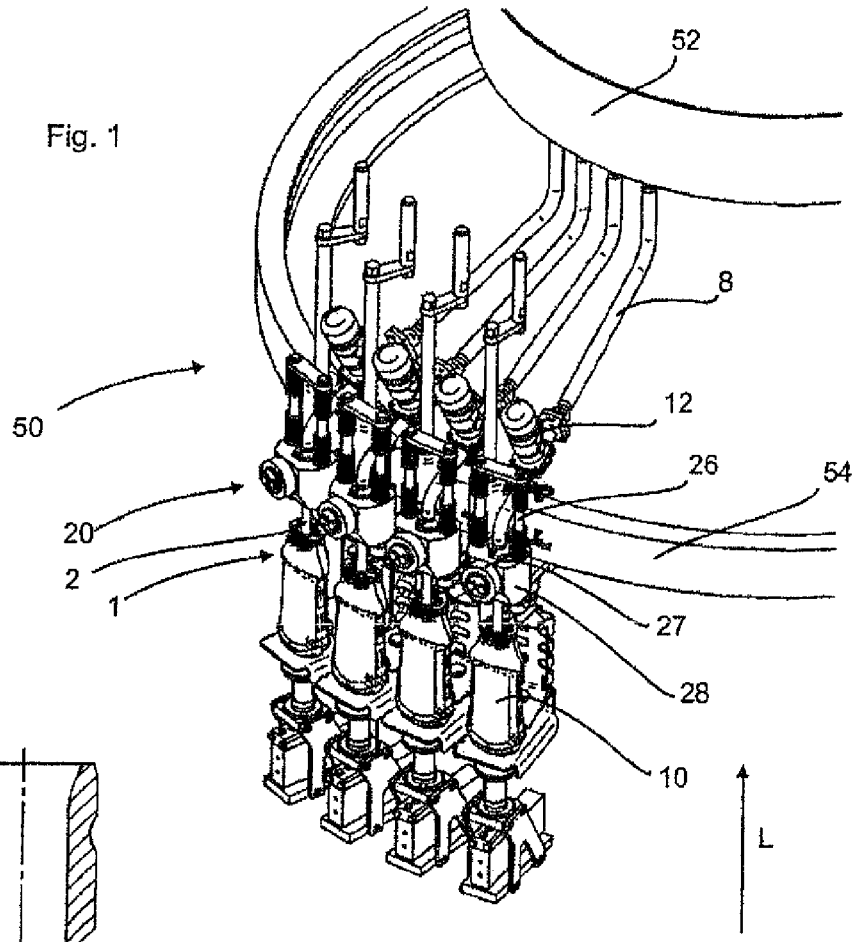
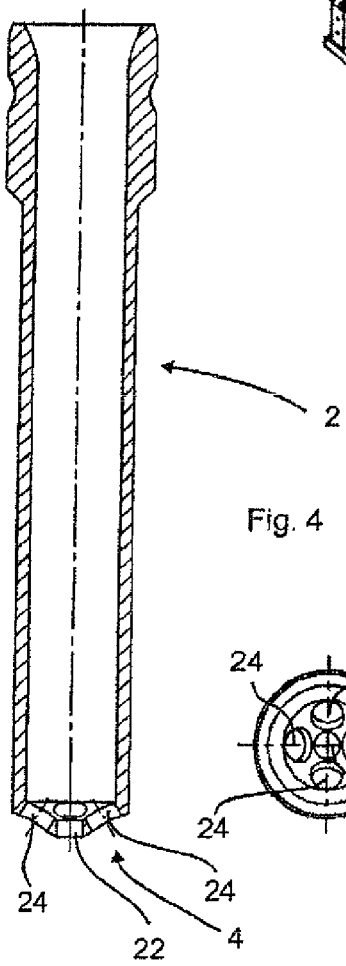
Fig. 4
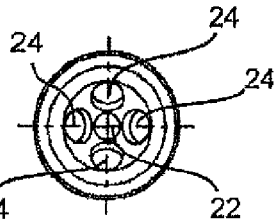
Fig. 4(a)

APPARATUS FOR BOTTLING VISCOUS MEDIA

FIELD OF THE INVENTION

Background of the Invention

The present invention relates to an apparatus for filling containers with liquid and in particular viscous media. Various apparatuses for filling containers are known from the prior art. In particular, apparatuses are also known which are used to bottle viscous media such as, for example, mustard, tomato ketchup and the like. In the case of such apparatuses, often a weighing cell or a weighing device is provided which measures the weight of the filled container. It is also known that, in the case of filling systems comprising a filling tube, in which this filling tube dips into the container to be filled, usually the bottles are raised relative to the fixed-level filling valve in order to bring about said dipping. However, this is disadvantageous if weighing cells are provided, since considerable vibrations occur during the lifting movement of the weighing cell together with the bottle located thereon, which vibrations interfere with the measurement and also the taring. In such cases, the filling process cannot begin until the vibrations are over and the weighing device is tared. The medium to be bottled is in particular a foodstuff.

WO 02/098785 discloses such a filling system. Here, the container together with the weighing cell is withdrawn from a long filling tube during the filling process in order to maintain a constant distance between the tip of the filling tube and a level of the liquid.

EP 1 623 952 discloses a relative movement between the bottle and the filling tube, wherein here too the bottle to be filled is moved, and wherein the intention is to achieve an underlayer-type filling of the product without excessive wetting of the outside of the filling tube with the product.

DE 3727866 A1 discloses a weight-actuated filling system of the rotation type. In this configuration, the height position of a filling tube is varied, but this apparatus is not suitable in particular for viscous media since it provides a free-jet filling tube which thus generates a turbulent filling with also a high degree of oxygen inclusion. Furthermore, DE 3727866 discloses a very complicated lifting mechanism for the filling tube, in which a carrier, a filling valve and a relatively long pipeline are also moved with the filling tube. It is thus difficult to achieve a precise introduction of the filling tube into the container, particularly since the lifting movements also have to take place very quickly due to the high machine outputs customary nowadays.

The object of the present invention is therefore to provide an apparatus for filling containers with in particular viscous media, which allows a precise bottling process. In addition, a mechanically simple and thus inexpensive embodiment is to be provided.

SUMMARY OF THE INVENTION

An apparatus according to the invention for filling containers with liquid and in particular viscous media comprises a filling element which can be introduced at least partially into a mouth of the container to be filled. A filling body of this filling element is configured in such a way that the medium is directed at least also onto a wall of the container. Also provided is a connecting line for conveying the liquid medium from a reservoir for the liquid medium to the container, wherein the filling element is movable relative to the container in a longitudinal direction of the container. According to the invention, the filling element is movable in the longitudinal direction of the container. The container itself is preferably not moved in its longitudinal direction during the filling process.

An apparatus is therefore provided which allows a precise bottling in particular also of viscous media, wherein at the same time the process of introducing the filling element into the container can also be controlled very precisely. In addition, the weighing process can also be carried out in a precise manner.

The apparatus preferably comprises a valve device which is arranged in the partially flexible connecting line between the reservoir and the container. This valve device is preferably a filling valve.

The apparatus preferably comprises a weight measuring device which determines the weight of the container to be filled. In particular, the weight is also determined during the actual filling process. By virtue of the apparatus according to the invention, therefore, it is possible to benefit from the advantages of a filling machine with a weighing cell while at the same time using a filling tube which dips into the container. The apparatus according to the invention is therefore suitable in particular for bottling viscous media. Due to the mobility of the filling element, vibrations have no effect on the weight measurement. Furthermore, it is also not necessary to provide lifting elements below the holder for the containers, resulting in a simplified design.

In a further advantageous embodiment, a movement amplitude of the valve device during the movement of the filling element in the longitudinal direction of the container is smaller than a movement amplitude of the filling element itself. In this way, as few elements of the apparatus as possible are moved to any considerable extent. The maximum amplitude required is defined in particular by the movement of the filling element itself. The devices arranged upstream of the liquid medium, in particular the filling valve and the connecting line, must in comparison be moved only to a lesser degree.

However, it would also be possible that the filling element is moved in the same way respectively with the same amplitude as the valve device. In this case, preferably both elements carry out a purely translational movement in the longitudinal direction of the container.

In a further advantageous embodiment, the apparatus comprises a guide device for guiding the movement of the filling element, and this guide device is arranged between the valve device and the container respectively closer to the container than the valve device. It is thus possible in particular to guide the filling element in a particularly precise manner, in particular along a substantially exact straight line. In this way, a very quick and precise introduction of the filling element even into containers with a small mouth cross-section is possible.

The guide device preferably comprises a guide rod which extends parallel to the longitudinal direction of the container. It would also be possible to provide a plurality of guide rods which extend parallel to the longitudinal direction of the container. These guide rods are also preferably arranged close to the container or close to the longitudinal direction of the container, so that a particularly precise guidance is possible. Advantageously, the guide rod is arranged above or below the container and extends in the longitudinal direction of the containers.

The guide device or a part thereof is preferably movable in the longitudinal direction of the container by means of a guide cam. With such a guide cam, very precise height differences and thus height adjustments can be achieved.

In a further advantageous embodiment, the filling body is configured in such a way that some of the medium passes directly from the filling body onto a bottom region of the container. In this way, a particularly low-oxygen filling is possible by filling both along the bottle wall in combination with a central product jet. This central product jet leads to the formation of hollow chambers or air chambers within the viscous product to be bottled. In this way, the oxygen inclusion within the product can in turn be reduced.

In a further advantageous embodiment, the filling body comprises a plurality of openings which direct the medium both onto a wall and onto a bottom region of the container. In this way, as described above, a particularly low-oxygen filling is possible without the formation of hollow spaces in the bottled product.

Preferably, a section of the connecting line is flexible. In particular, this is a section which is arranged in front of or upstream of the abovementioned valve. This flexible section allows a movement of the filling element, wherein in this case the filling valve is also moved with a smaller amplitude than the filling element.

The filling body is preferably movable only in a range which is small relative to the longitudinal dimension of the container. With particular preference, the range is sufficient for the end of the filling body to be introduced through the mouth into a region of the container which is located directly below the mouth, for example in the region of a bottle shoulder. A minimal lifting movement is thus provided, which in turn results in a lower design complexity for the installation as a whole.

Furthermore, the apparatus particularly preferably allows different filling rates so as to achieve an exact filling quantity. For example, it is possible to provide a plurality of valve units which allow these different filling rates. The valve device may be in particular, but not exclusively, a membrane valve. A further membrane valve can be provided for a different filling rate. It is thus also possible to control the flow rate of the product.

This therefore allows a combination of a weighing filling machine with a filling tube which dips into the container, wherein the container to be filled is held below the filling valve preferably centred by means of shaped parts or a neck handling clamp. The abovementioned filling valve and thus the filling element is lowered until the filling tube or the filling body dips just far enough into the container that bubble-free filling can take place through the lateral openings of the filling body onto the container wall.

The container in this case stands, without being raised, on the weight measuring device used to determine the filling weight. The abovementioned valve devices such as double membrane valves allow up to 3 different filling rates, as a result of which in particular the filling rate in the critical neck region of the bottle can be optimally selected. By virtue of the membrane valve, a very simple filling valve design is possible since no valve rod having a valve cone with corresponding sealing of the axial movement, for instance by means of a bellows, has to be used in the product path.

In a further advantageous embodiment, the weight measuring device is arranged directly below the container. This also allows a very precise weight measurement.

The present invention also relates to an arrangement for filling containers in particular with a viscous medium, wherein this arrangement comprises a reservoir for the liquid medium and a plurality of apparatuses of the type described above.

The present invention also relates to a method for filling containers with liquid and in particular viscous media, wherein a filling element is introduced into the container through a mouth of the container, and the medium coming from a filling body of the filling element is directed onto a wall of the container, and the medium is conveyed via a connecting line from a reservoir to a filling body, and wherein before and after the filling process the filling element is moved relative to the container in a longitudinal direction of the container. According to the invention, before and after the filling process the filling element is moved in the longitudinal direction of the container and the container itself is not moved in this longitudinal direction. It would also be possible to move the filling element during the filling process.

The method according to the invention also allows a particularly precise filling of containers with viscous media.

In one preferred method, the filling element is moved by means of a guide device, on which preferably the filling element is arranged. The component to be moved, namely the filling element, is thus accurately moved and in this way it is possible in particular to carry out this movement in a very precise manner.

BRIEF DESCRIPTION OF THE DRAWINGS

Further advantages of the embodiments will emerge from the appended drawings:

In the drawings:

FIG. 1 shows a partial view of an arrangement according to the invention for filling containers with viscous media;

FIGS. 4 and 4(*a*) show two views of a filling element according to the invention.

DETAILED DESCRIPTION OF PREFERRED EMBODIMENTS

Figure 2:
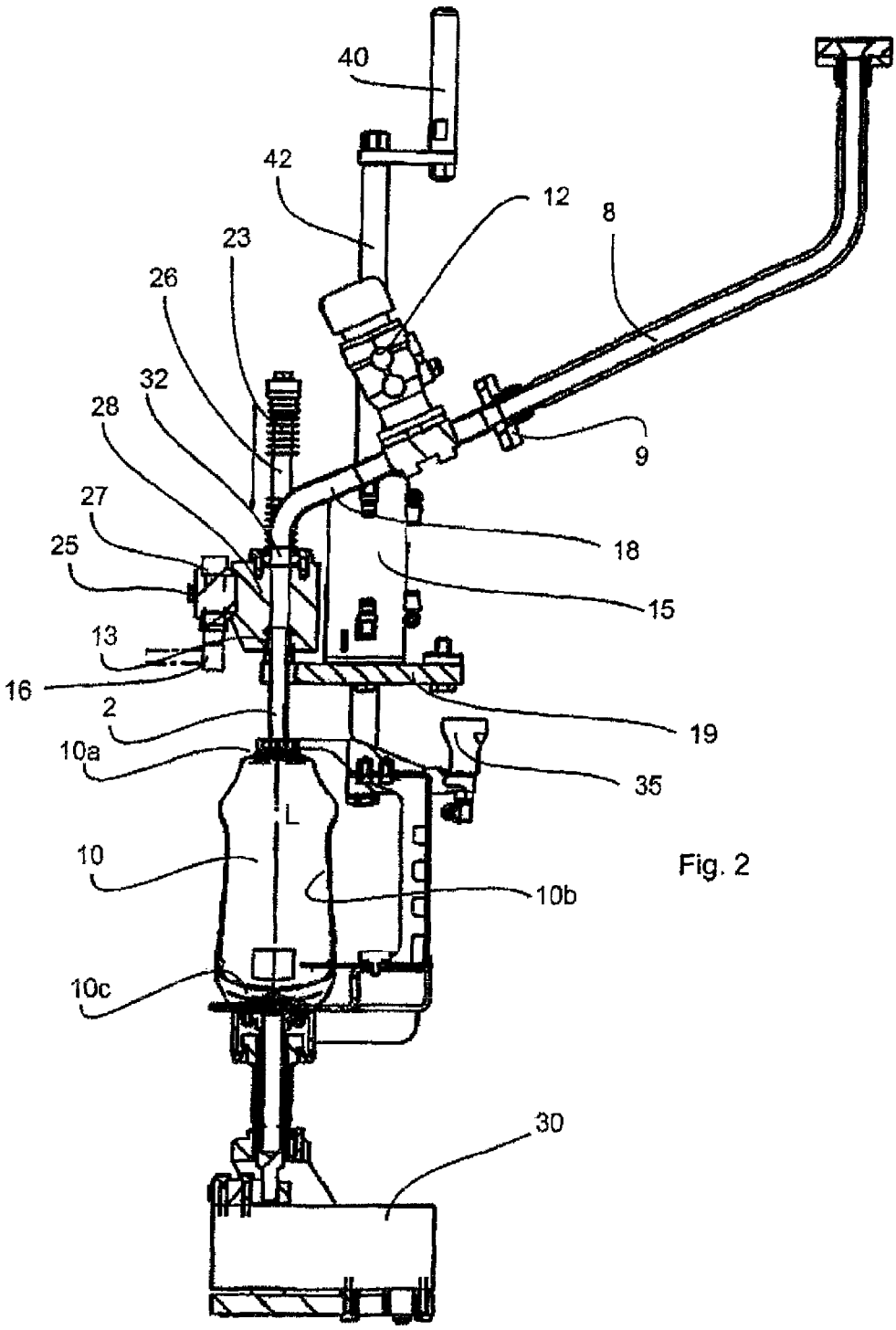
FIG. 2 shows an apparatus according to the invention for filling containers with the viscous medium in a first embodiment.

FIG. 1 shows an arrangement 50 for filling containers 10. These are containers 10 into which a viscous medium is to be filled. The arrangement comprises a reservoir 52, in which the medium to be bottled is arranged. Via a connecting line, of which only an upper part 8 can be seen here, the medium passes to a plurality of filling elements 2 which respectively protrude into a mouth of the containers 10 during the filling process. Reference 20 denotes, as a whole, guide devices which displace the individual filling elements 2 in the longitudinal direction L in order to start the filling process.

The guide device 20 comprises guide rods 26, along which a guide body 28 can be displaced in the longitudinal direction L. Reference 27 denotes a roller which is mounted such that it can rotate about a bolt, wherein this roller 27 cooperates with a guide cam 16 (not shown) in order to bring about the longitudinal movement of the filling elements 2. Reference 12 denotes a valve device within the connecting line. Reference 54 denotes a carrier, on which the apparatuses 1 are arranged so as to be conveyed here along a circular path. This carrier therefore forms part of a transport device (not shown in its entirety) for transporting the apparatuses 1 and thus also the containers 10.

FIG. 2 shows an apparatus according to the invention in a first embodiment. It can be seen here that the connecting line has two sections 8 and 18, wherein the upper section 8 is flexible and is connected to the section 18 via a flange 9. This flexible section 8 allows a longitudinal movement of the filling element 2 in the longitudinal direction L.

More specifically, the guide body 28 is moved in the longitudinal direction L and therefore the elastic section 8 of the connecting line bends. The valve element 12 thus moves with a smaller amplitude than the guide body 28. A very precise longitudinal movement is also possible by means of the cam path respectively the guide cam 16.

Reference 25 denotes a roller bolt, around which the roller 27 is arranged in a rotatable manner. The connecting piece 18 is attached to the guide body 28 by means of a flange 32. The guide body 28 and thus also the filling element can be moved relative to the rod 26. In general, the valve body 12 is connected to the product reservoir 52 (cf. FIG. 1) by means of a movable element, such as an elastic tube in this case.

In the embodiment shown here, the valve body is moved by means of a lifting cam or guide cam 16; however, it would also be possible to use a pneumatic cylinder for the lifting movement. An automatic CIP cap 35 may be attached to the movable valve. However, it would also be possible to configure this CIP cap such that it can be used manually.

Reference 40 denotes an actuation element which is connected to the CIP cap 35 via a rod 42 in order to pivot said cap. More specifically, the CIP cap 35 can be pushed below the end of the filling element 2 in order to cover the latter. Lifting elements may be provided on a CIP mechanism 15 in order to press the CIP cap 35 onto the filling element from below.

Furthermore, a further guide cam may be provided which actuates the actuation elements 40, for example pushes these outwards in FIG. 1, in order to pivot the CIP caps 35. With the CIP cap 35 closed, an internal cleaning of the filling element and also of the connecting lines 8, 18 is possible.

By means of the filling element 2 or a filling body of this filling element 2 which will be described in more detail below and which is then introduced into the mouth 10*a* of the container, it is possible to wet both the side walls 10*b* and also the bottom region 10*c* with the product. In this way, it is possible to convey the product from the reservoir 52 to the valve 12 above a static pressure or with a slight overpressure in the range from 0.05 to 0.8 bar.

Reference 30 denotes a weighing cell which is arranged below the container and determines the weight thereof even during the filling process. As mentioned above, reference 15 denotes the CIP mechanism which is arranged on a holding plate 19. A spring device biases the filling element 2 in a certain direction, for example in the downward direction or towards its lower operating position.

Figure 3:
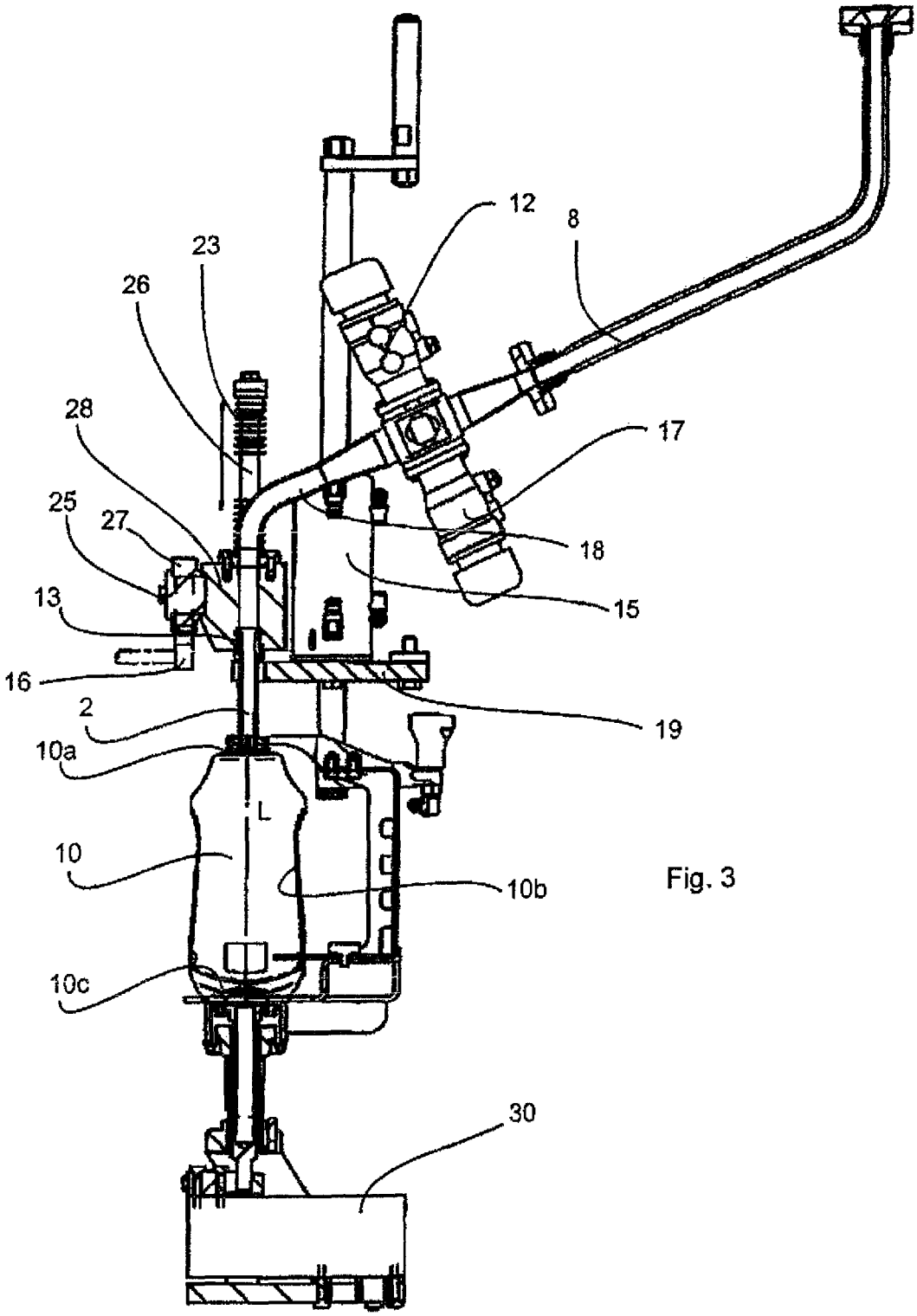
FIG. 3 shows an apparatus for filling containers with a viscous medium in a further embodiment.

FIG. 3 shows a further embodiment of an apparatus according to the invention for filling containers. In this embodiment, two valves 12, 17 are provided which allow additional filling rates. In general, the container 10 to be filled is held in a centered manner below the filling element, wherein for this purpose use is made of format parts or neck handling clamps. In this embodiment, the two valves may be membrane valves and may preferably be provided next to one another in the line 18, so that the flow cross-section can be controlled in three stages (both valves open; first valve open, second valve closed; first valve closed, second valve open). Here, the lines 8 and 18 accordingly have a somewhat larger cross-section than the sum of the cross-sections of the two line sub-sections within the membrane valves in the embodiment shown in FIG. 2.

FIGS. 4 and 4(*a*) show two views of a filling element 2 according to the invention. This filling element 2 has at its lower end a filling body 4 which here has a central opening 22 and four lateral or angled openings 24. Via the central opening 22, the product is guided directly onto the bottom of the container, whereas the angled openings 24 bring about a wetting of the container inner wall. In this case, the entire filling valve is lowered until the filling body 4 dips just far enough into the bottle that bubble-free filling can take place through the lateral openings or run-outs 24 of the filling body onto the container inner wall. The illustrated additional axial opening 22 in the filling body allows an additional product jet directly onto the container bottom 10*c* (cf FIGS. 2, 3).

This prevents the highly viscous product from incorporating air as it amalgamates on the container bottom. This is helpful for example, as mentioned above, in the case of ketchup since the oxygen in the bubbles would react with the product and would lead to black discoloration of the product.

During the filling process the container stands, without being lifted, on the weight measuring device 30 which serves to determine the filling weight. By virtue of the abovementioned double membrane valve 12, up to three filling rates are possible, wherein the filling rate in the critical neck region of the bottle can be optimally selected.

All of the features disclosed in the application documents are claimed as essential to the invention in so far as they are novel individually or in combination with respect to the prior art.

The invention claimed is:

1. An apparatus for filling containers with a liquid medium, comprising a filling element which can be introduced at least partially into a mouth of the container to be filled, wherein a filling body of the filling element is configured in such a way that the liquid medium is directed at least also onto a wall of the container, comprising a connecting line for conveying the liquid medium from a reservoir for the liquid medium to the container, wherein the filling element is movable in the longitudinal direction (L) of the container and wherein the filling body is movable only in a range which is small relative to the longitudinal dimension of the container, wherein the range is sufficient for the end of the filling body to be introduced through the mouth into a region of the container which is located directly below the mouth and wherein this range is such, that an end of the filling body is located directly in a region of a bottle shoulder, wherein the liquid medium is conveyed from the reservoir to a valve of the filling element with a slight overpressure in the range of from 0.05 to 0.8 bar, and wherein the filling body comprises a plurality of openings which direct the liquid medium both onto a wall and onto a bottom region of the container.

2. The apparatus according to claim 1, wherein the apparatus comprises a valve device which is arranged in the connecting line between the reservoir and the container.

3. The apparatus according to claim 1, wherein the apparatus comprises a weight measuring device which determines the weight of the container to be filled.

4. The apparatus according to claim 2, wherein the apparatus comprises a guide device for guiding the movement of the filling element, and the guide device is arranged between the valve device and the container.

5. The apparatus according to claim 4, wherein the guide device comprises guide rods along which a guide body can be displaced in the longitudinal direction (L) of the container.

6. The apparatus according to claim 5, wherein the guide body is movable in the longitudinal direction (L) of the container using a guide cam.

7. The apparatus according to claim 1, wherein the filling body is configured in such a way that some of the liquid medium passes directly from the filling body onto a bottom region of the container.

8. The apparatus according to claim 1, wherein a section of the connecting line is flexible.

9. The apparatus according to claim 3, wherein the weight measuring device is arranged directly below the container.

10. A system for filling containers with a liquid medium, comprising a reservoir for the liquid medium and comprising a plurality of apparatuses according to claim 1.

11. A method for filling containers with a liquid medium, wherein a filling element is introduced into the container through a mouth of the container, the liquid medium coming from a filling body of the filling element is directed onto a wall of the container, the liquid medium is conveyed via a connecting line from a reservoir to the filling body, wherein during the filling process the filling element is moved relative to the container in a longitudinal direction (L) of the container, wherein during the filling process the filling element is moved in the longitudinal direction (L) of the container and the container is not moved in this longitudinal direction (L), and wherein the filling body is movable only in a range which is small relative to the longitudinal dimension of the container, wherein the range is sufficient for the end of the filling body to be introduced through the mouth into a region of the container which is located directly below the mouth and wherein this range is such, that an end of the filling body is located direction in a region of a bottle shoulder, wherein the liquid medium is conveyed from the reservoir to a valve of the filling element with a slight overpressure in the range from 0.05 to 0.8 bar, and wherein the liquid medium is directed both onto a wall and onto a bottom region of the container via a plurality of openings which the filling body comprises.

12. The method according to claim 11, wherein the filling element is moved using a guide device which is arranged on the filling element.

13. An apparatus according to claim 3, wherein the apparatus comprises a guide device for guiding the movement of the filling element, and the guide device is arranged between the valve device and the container.

14. The apparatus according to claim 3, wherein the liquid medium comprises a viscous media.

15. The apparatus according to claim 10, wherein the liquid medium comprises a viscous media.

16. The apparatus according to claim 11, wherein the liquid medium comprises a viscous media.

17. The apparatus according to claim 1, wherein a CIP cap is provided.

18. An apparatus for filling containers with liquid medium, comprising a filling element which can be introduced at least partially into a mouth of the container to be filled, wherein a filling body of this filling element is configured in such a way that the liquid medium is directed at least also onto a wall of the container, comprising a connecting line for conveying the liquid medium from a reservoir for the liquid medium to the container, wherein the filling element is movable in the longitudinal direction (L) of the container and wherein the filling body is movable only in a range which is small relative to the longitudinal dimension of the container, wherein the range is sufficient for the end of the filling body to be introduced through the mouth into a region of the container which is located directly below the mouth and wherein this range is such, that an end of the filling body is located directly in a region of a bottle shoulder, wherein the liquid medium is conveyed from the reservoir to a valve of the filling element with a slight overpressure in the range from 0.05 to 0.8 bar, wherein the filling body has at its lower end a central opening, through which the product is guided directly onto the bottom of the container and lateral or angled openings which bring about a wetting of the container inner wall.

* * * * *